United States Patent [19]

Christian

[11] 4,245,771

[45] Jan. 20, 1981

[54] CONTAINER HAVING TRAPEZOIDAL CROSS-SECTION

[75] Inventor: William G. Christian, Ravenna, Ohio

[73] Assignee: Container Corporation of America, Chicago, Ill.

[21] Appl. No.: 165,696

[22] Filed: Jul. 3, 1980

[51] Int. Cl.[3] ..... B65D 5/10

[52] U.S. Cl. ..... 229/22; 229/16 R

[58] Field of Search ..... 229/22, 16 R

[56] References Cited

U.S. PATENT DOCUMENTS

| | | | |
|---|---|---|---|
| 1,758,585 | 5/1930 | Riegel | 229/22 |
| 2,022,721 | 12/1935 | Hompe | 229/22 X |
| 2,942,768 | 6/1960 | McCall | 229/16 R |
| 3,178,092 | 4/1965 | Munana et al. | 229/22 |
| 3,231,077 | 1/1966 | Grimm | 229/22 X |
| 3,482,760 | 12/1969 | Pascus et al. | 229/22 |

FOREIGN PATENT DOCUMENTS

| | | | |
|---|---|---|---|
| 2324828 | 12/1973 | Fed. Rep. of Germany | 229/22 |
| 1445636 | 6/1966 | France | 229/22 |
| 456442 | 7/1968 | Switzerland | 229/22 |

*Primary Examiner*—Davis T. Moorhead

*Attorney, Agent, or Firm*—Richard W. Carpenter

[57] ABSTRACT

Container for an article of commerce has a configuration substantially corresponding to the configuration of the article and is formed with a front panel which can be pulled out and dropped into horizontal position for easy loading or reloading of the container.

5 Claims, 6 Drawing Figures

CONTAINER HAVING TRAPEZOIDAL CROSS-SECTION

BACKGROUND OF THE INVENTION

1. Field of the Invention

The invention structure finds particular application in the packaging of appliances, such as electric irons or the like. The structure must be extremely sturdy in view of the weight of the appliance.

2. The Prior Art

The present invention represents an improvement over that disclosed in Munana et al U.S. Pat. No. 3,178,092 in that the bottom of the present structure is reinforced by additional panel elements and in that the top closure is accomplished by overlapping closure panels.

SUMMARY OF THE INVENTION

A container having a trapezoid cross-section comprises front, bottom and back panels with opposed trapezoidally shaped end panels joined to the back panels. End panels have inner reinforcing panels locked in spaced planar relationship to the end panels. Th front panel has tuck flaps which can enter into recesses formed between certain panels while the front and the back panels are provided with closure flaps to close the top of the container.

THE DRAWINGS

Figure 1:
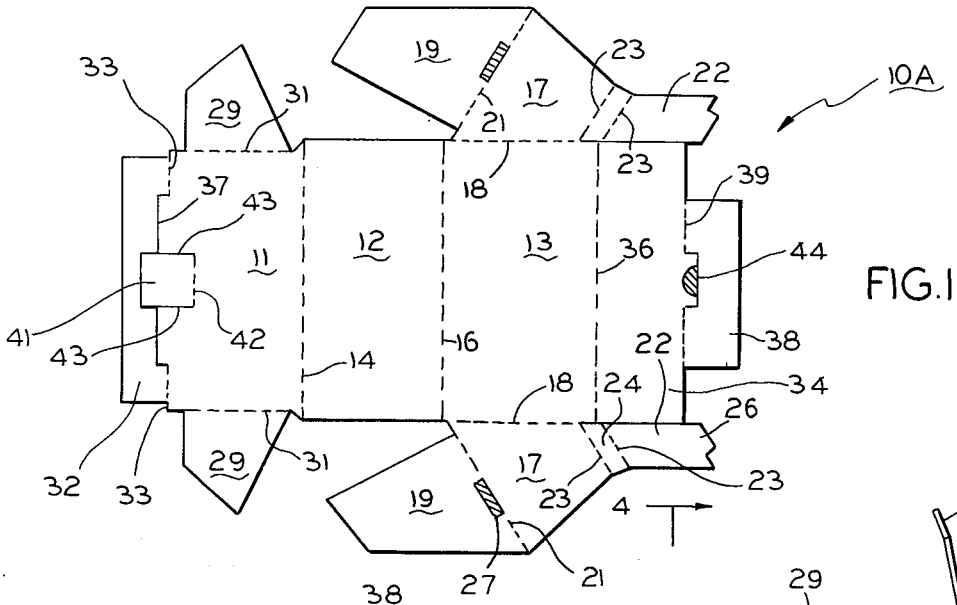
FIG. 1 is a plan view of a cut and scored blank for forming a container according to the present invention.
Figure 3:
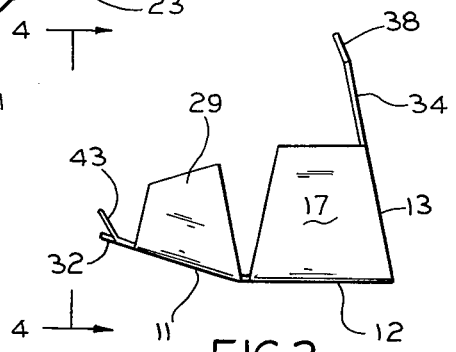
FIG. 3 is an end view showing the container partly erected.
Figure 4:
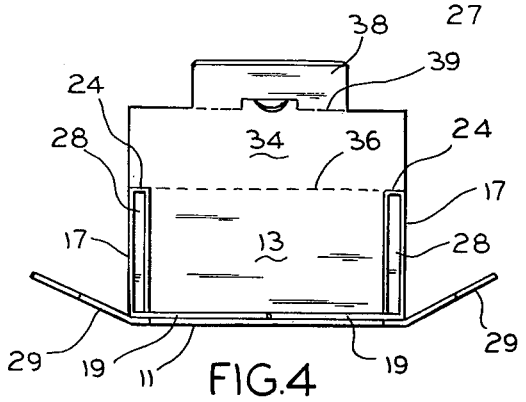
FIG. 4 is a sectional view taken generally along the line 4—4 of FIG. 3.
Figure 2:
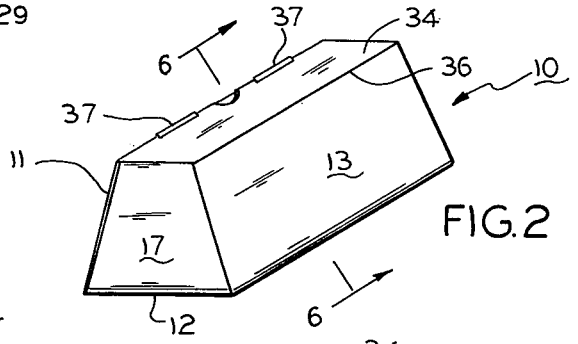
FIG. 2 is an isometric view showing the blank of FIG. 1 erected and closed to form the container of FIG. 1.
Figure 5:
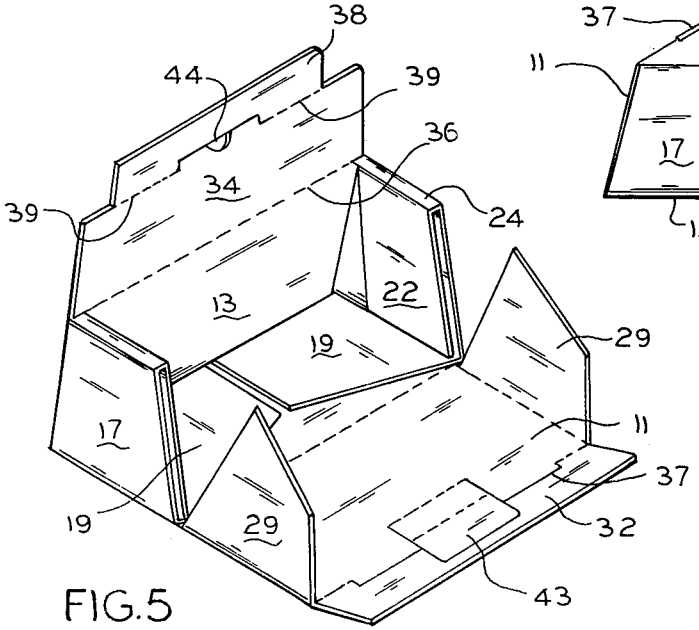
FIG. 5 is an isometric view showing a step in erecting the container of the present invention.
Figure 6:
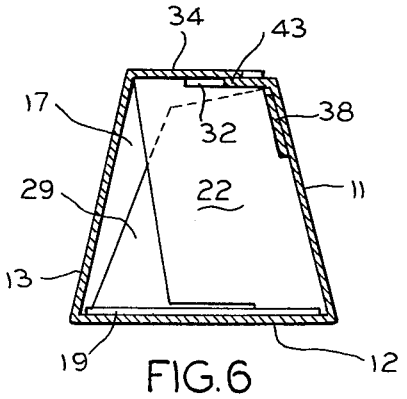
FIG. 6 is a sectional view taken generally along the line 6—6 of FIG. 2.

A container having a trapezoidal cross-section and formed according to the present invention is denoted generally by the reference numeral 10 as best seen in FIG. 2, and is formed from a cut and scored blank 10A of paperboard, or the like, illustrated in FIG. 1.

The container 10 and the blank 10A consist of a front panel 11, a bottom panel 12 and a back panel 13, these being joined along parallel score lines 14 and 16.

An outer end panel 17 has a trapezoidal configuration with its major side connected along a fold line 18 to each end of the back panel. Foldably connected to the end panel 17 along a fold line 21, is a bottom reinforcing panel 19 arranged to overlie the bottom panel 12 along the inner face thereof.

An inner end panel 22 is connected to the trapezoidal panel 17 along the minor base thereof by parallel score lines 23 which define a small spacer element 24.

A free end of the inner end panel 22 is provided with a locking tab 26 engageable with a locking slot 27 disposed in the bottom reinforcing panel 19 adjacent the fold line 21.

Folding of the inner end panel 22 against the outer end panel 17 produces a recess 28 between the two panels.

A tuck flap 29 is foldable with respect to each end of the front panel 11 along a fold line 31 to a position where it can be received into the recess 28 after the container 10 has been loaded with an article of commerce.

A lower top locking flap 32 is foldable with respect to the front panel 11 along a fold 33 into a position forming a portion of the top of the container. Slits 37 are formed in the locking flap 32 by cut lines which are spaced from and positioned parallel to the fold line 33.

At the opposite end of the blank, an upper top locking flap 34 is connected to the back panel 13 along a hinge line 36. The flap 34 has an extension flap 38 foldably hinged thereto along a fold line 39.

The extension flap 38 is inserted into the slits 37 to lie along the inner face of the front panel 11 thereby closing the top of the container.

A locking tab 41, formed from material of the front panel 11 and the lower top locking flap 32, is connected by a hinge line 42 to the front panel 11 and is flanked by spaced cut lines 43 intersecting the slits 37.

The closing structure thus far described is such that when the lower top locking flap 32 is brought into position forming a portion of the top of the container and the upper closing flap 34 is placed atop the flap 32 with the extension 38 inserted into the slits 37, the locking tab 41 can be entered into a slit 44 in the extension 38 to complete locking of the container.

I claim:

1. A container having a trapezoidal cross-section and formed from a unitary blank of paperboard or the like, comprising:

(a) front, bottom and back panels connected along parallel score lines;

(b) opposed trapezoidally shaped outer end panels foldably secured to opposite edges of said back panel;

(c) bottom panel reinforcing flaps foldably joined to said outer end panels along the first edges thereof and overlying said bottom panel;

(d) each of said bottom panel reinforcing flaps having a slot formed therein;

(e) inner end panels foldably joined to the second edges of said outer end panels and extending into said slots for locking engagement therewith;

(f) said inner and outer end panels defining recesses therebetween;

(g) tuck flaps foldably attached to the ends of said front panel and movably received in said recesses;

(h) a first top locking flap hinged to said front panel and folded with respect thereto into substantially parallel relationship with said bottom panel thereby forming a portion of a top closure of said container;

(i) a second top locking flap hinged to said back panel and folded with respect thereto to overlie said first top locking flap thereby closing the top of said container.

2. The container according to claim 1, wherein said first top locking flap has at least one slit formed therein and said second top locking flap has an extension flap foldably hinged to an edge thereof.

3. The container according to claim 2, wherein said extension flap is removably received in said slit.

4. The container according to claim 1, wherein a locking tab is formed from material of said front panel and hingedly secured thereto.

5. The container according to claim 4, wherein said locking tab is releasably attached to said second top locking flap.

* * * * *